United States Patent [19]

Gerhardy

[11] Patent Number: 4,578,228

[45] Date of Patent: Mar. 25, 1986

[54] CARBURETOR FOR AN INTERNAL COMBUSTION ENGINE

[75] Inventor: Reinhard Gerhardy, Korb, Fed. Rep. of Germany

[73] Assignee: Andreas Stihl, Waiblingen, Fed. Rep. of Germany

[21] Appl. No.: 667,016

[22] Filed: Nov. 1, 1984

[30] Foreign Application Priority Data

Nov. 3, 1983 [DE] Fed. Rep. of Germany ..... 3339714

[51] Int. Cl.[4] ..... F02M 3/08

[52] U.S. Cl. ..... 261/41 D; 261/121 B; 261/35; 261/DIG. 68

[58] Field of Search ..... 261/41 D, 121 B

[56] References Cited

U.S. PATENT DOCUMENTS

| | | | |
|---|---|---|---|
| 2,419,956 | 5/1947 | Kuzelka | 261/121 B |
| 3,454,264 | 7/1969 | Sarto | 261/41 D |
| 3,575,390 | 4/1971 | Bickhaus et al. | 261/121 B |
| 3,608,874 | 9/1971 | Beckmann | 261/41 D |
| 3,937,766 | 2/1976 | Garcea et al. | 261/41 D |

FOREIGN PATENT DOCUMENTS

| | | | |
|---|---|---|---|
| 329749 | 11/1920 | Fed. Rep. of Germany | 261/41 D |
| 687024 | 1/1940 | Fed. Rep. of Germany | 261/41 D |
| 754599 | 7/1954 | Fed. Rep. of Germany | 261/41 D |
| 11367 | 10/1924 | Netherlands | 261/41 D |
| 731016 | 4/1980 | U.S.S.R. | 261/41 D |

*Primary Examiner*—Tim Miles
*Attorney, Agent, or Firm*—Walter Ottesen

[57] ABSTRACT

A carburetor for small motors has a housing with a carburetor bore wherein air and fuel are mixed to an air fuel mixture. The fuel enters the carburetor bore through fuel jets. A throttle valve is pivotally mounted in the carburetor bore by means of which the fuel-air mixture quantity is adjusted in dependence upon the operating condition of the engine. The throttle valve and the inner wall surface of the carburetor bore conjointly define an air gap in the idling position. An idling fuel outlet jet communicates with the carburetor bore in the region of this air gap and is connected to the control chamber containing the fuel. The idling fuel outlet jet together with a ventilation bore communicate with an emulsion chamber of the control compartment. Further, an idling control part is provided which is movable into the air gap whereby an outlet opening of the ventilation bore communicating with the emulsion chamber is passed over. In this way, the ratio of fuel to air in the emulsion chamber can be adapted to the air requirements when flowing into the carburetor bore from the outlet jet. By means of a change of the free cross-sectional opening of the ventilation jet occurring simultaneously with the entry of the control part into the air gap, the air to fuel ratio remains constant so that a subsequent adjustment of the components of the mixture is unnecessary.

17 Claims, 7 Drawing Figures

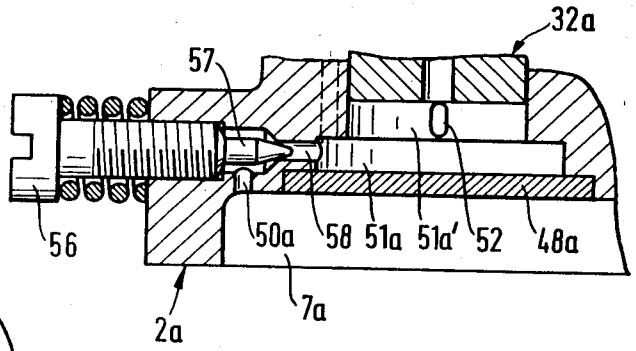
Fig. 4
Fig. 5
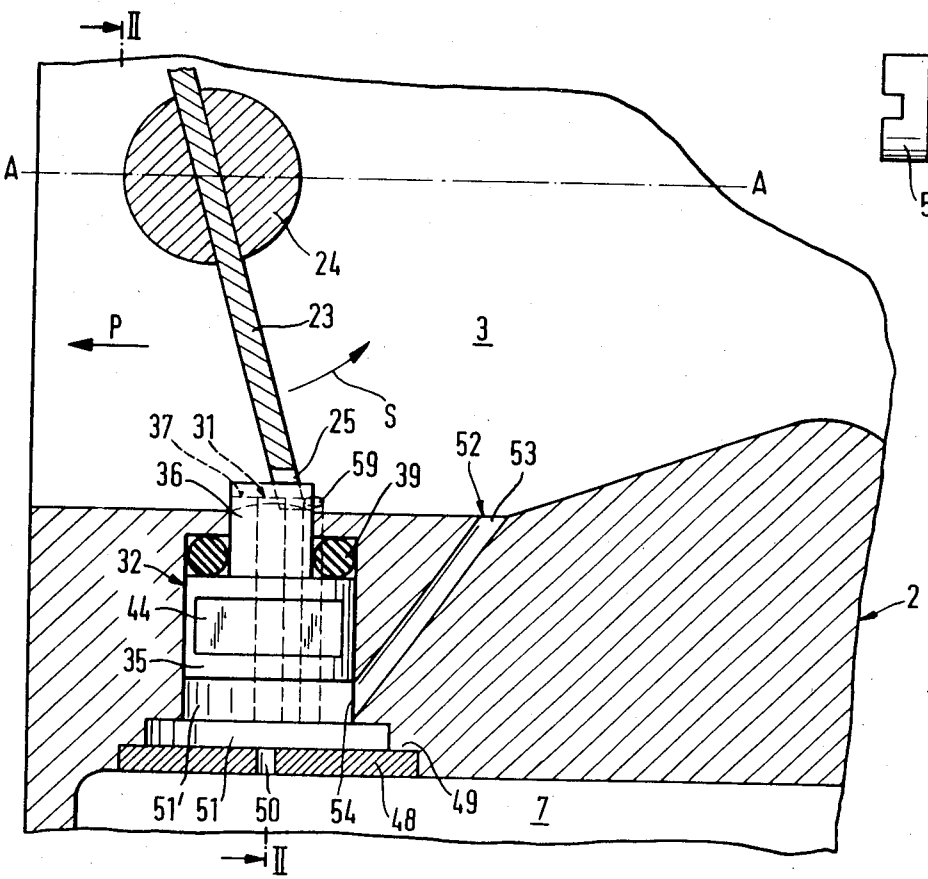

CARBURETOR FOR AN INTERNAL COMBUSTION ENGINE

FIELD OF THE INVENTION

The invention relates to a carburetor for gasoline engines particularly portable small motors. The carburetor includes a housing with a venturi extending therethrough wherein air is mixed with fuel entering via inlet jets to form an air-fuel mixture. A throttle valve is pivotally mounted in the venturi for adjusting the air-fuel mixture required by the engine in dependence upon its operating condition. In the idle condition of the engine, the throttle valve or flap and the inner wall surface of the venturi conjointly define an air gap in the region of which an idle outlet jet discharges. An adjusting member is provided to change the cross-sectional area of the air gap for the idling air.

BACKGROUND OF THE INVENTION

In one carburetor of this kind, an idling fuel jet, an acceleration jet, a ventilation jet, and a main jet are provided one behind the other in the venturi. At the idle setting for the throttle valve, the idle fuel outlet jet lies in front of the throttle valve in the direction of the air flow, that is, on the side facing toward the motor; whereas, the acceleration jet and the main jet lie behind the throttle valve on the opposite side.

During idle, fuel is drawn in by suction only through the idling jet. When, during acceleration, the throttle valve is pivoted, it sweeps over the acceleration jet after a slight rotating movement, so that this jet too lies in front of the throttle valve. The fuel then flows from the idling jet as well as from the acceleration jet. When the throttle valve is opened further, and finally lies in line with the flow direction, the greatest part of the fuel is drawn by suction from the main jet.

The idle adjusting part serves to fix the position of the throttle valve in that it fixes the throttle valve in the idling position. This idle adjusting part is an abutment screw on which the throttle valve lies with a pivot arm. To change the idling speed, the throttle valve is pivoted by means of this abutment screw whereby the available air gap between the throttle valve and the inner wall surface of the venturi is made smaller or larger. This has the disadvantage that the acceleration jet lying behind the throttle valve is disposed at only a small spacing from the throttle flap. In this way, the throttle valve enters the area of the acceleration jet with only minimal pivoting thereby causing fuel to flow from this jet which can lead to a considerable change in the mixture. In order to compensate for this, an idling fuel screw must be adjusted thereafter in order to diminish the quantity of fuel moving through the idling fuel jet. Consequently, both adjustment screws must be set with respect to each other in order to attain the optimum setting for the idling mixture, which is troublesome and time consuming, and requires a certain amount of experience on behalf of the operator.

Also, when the acceleration jet lies at a greater spacing behind the throttle valve, this complicated adjustment of both adjustment screws is unavoidable. In this situation, the throttle valve is easily adjusted, since a slight pivoting movement does not cause the valve to reach the area of the acceleration jet; however, the mixture will still be altered by a slight change in the position of the throttle valve.

Opening or closing the throttle valve will enlarge or diminish the air gap thereby causing the amount of entering air to vary correspondingly. The fuel-air mixture therefore becomes too lean or too rich by a slight adjustment of the throttle valve, which must again be compensated for by a follow-up adjustment of the fuel adjustment screw. Consequently, in both cases, the idling adjustment screw as well as the idling fuel screw must be adjusted with respect to each other to obtain the optimum idling adjustment which is difficult and time consuming, especially for laymen.

SUMMARY OF THE INVENTION

It is an object of the invention to configure a carburetor of the kind described above so that the optimum idling setting can be obtained easily and rapidly with only one adjustment.

The carburetor of the invention includes: a carburetor housing defining a carburetor bore communicating with the engine and through which a stream of air is drawn by suction when the engine is operating; a plurality of fuel jets for delivering fuel into the bore and the stream of air flowing therethrough to form a fuel-air mixture for the engine; a throttle flap pivotally mounted in the carburetor bore for adjusting the quantity of the mixture in dependence upon the operating condition of the engine; the throttle flap being pivotable to an idle position whereat the throttle flap and the wall surface of the carburetor bore conjointly define an air gap for passing the air required for the idle operation of the engine; a control compartment for holding the fuel for the fuel jets, the control compartment including an emulsion chamber; one of the fuel jets being an idle speed fuel jet having its outlet opening in the region of the air gap, the idle speed fuel jet also communicating with the emulsion chamber; air passage means for passing air to the emulsion chamber, the passage means having a pass-through opening communicating with the emulsion chamber; and, idle speed adjustment means for changing the cross-sectional area of the air gap while simultaneously changing the cross-sectional area of the pass-through opening so as to cause the ratio of fuel to air of the emulsion in the emulsion chamber to be adapted to the air supply required by the engine as the emulsion flows out from the idle speed fuel jet.

In the carburetor according to the invention, the throttle valve or flap no longer is pivoted for the idling adjustment; instead, the idling adjusting part is moved into and out of the air gap. The throttle valve therefore assumes the same unchanged position for idling adjustment so that it no longer comes into the region of the acceleration jet during idling adjustment thereby causing an increased metering of fuel.

By means of the simultaneous alteration of the free cross-sectional area of the ventilation jet, the air-fuel mixture remains constant so that the fuel mixture reaching the engine from the idling fuel outlet jet can become neither too lean nor too rich. In this way, the disadvantageous adjustment of the mixture by means of the idling-fuel screw in order to compensate for an undesirable change in the mixture is eliminated. Consequently, the optimal idling speed can be set easily and quickly with little manipulation of the idling adjusting part, even by laymen, whereby a sensitive adjustment of two screws with respect to each other can be dispensed with.

BRIEF DESCRIPTION OF THE DRAWING

The invention will now be described with reference to the drawing wherein:

FIG. 4 is a view of the control chamber and the fuel-mixing chamber connected thereto, the view also showing an adjustment screw according to a further embodiment of the invention in an enlarged view taken in a vertical section at the axis of the venturi;

FIG. 5 is a part of the carburetor of FIG. 1, in section and taken through the longitudinal axis of the venturi, showing the idling adjusting part and the throttle valve in the idling position;

DESCRIPTION OF THE PREFERRED EMBODIMENTS OF THE INVENTION

Figure 1:
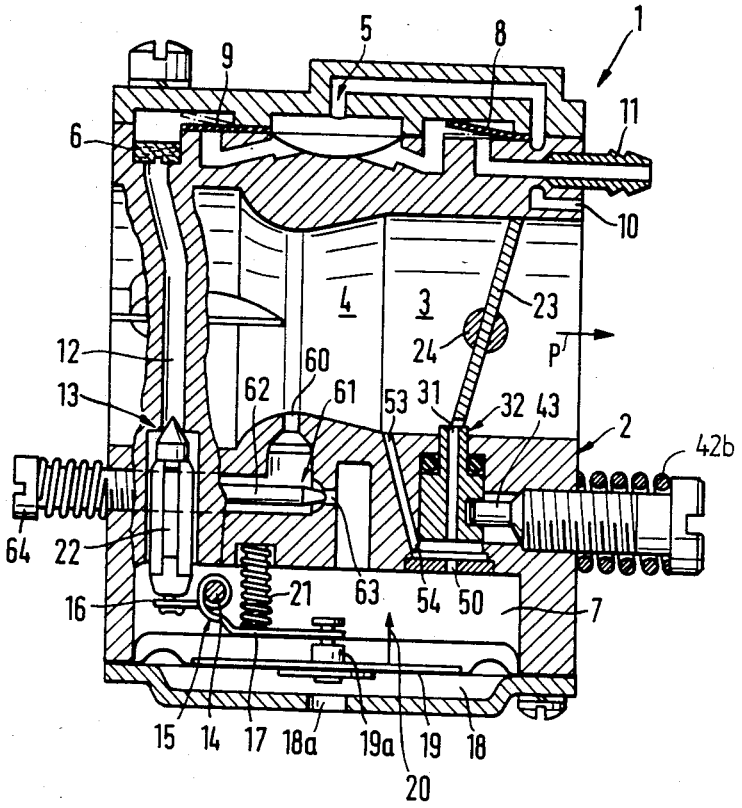
FIG. 1 is an elevation view of a carburetor according to the invention taken in axial section through the venturi.

The carburetor 1 has a carburetor housing 2 in which a fuel pump 5 and a control chamber 7 supplied by the fuel pump 5 through a fuel filter 6 are arranged around a centrally arranged continuous carburetor bore 3 having a tapered portion 4 defining an air funnel or venturi. The fuel pump 5 is configured as a diaphragm pump with two flap valves 8, 9. The pump 5 is connected via a connection 10 with a crankcase (not shown) of an internal combustion engine (also not shown) associated with the carburetor 1 and is further connected to a fuel tank (not shown) via a further connection.

A fuel channel 12 leads into the control chamber 7 and is closed with respect to the latter by an inlet valve 13. Essentially, the inlet valve 13 is made up of a two arm lever 15 pivotally mounted about axis 14. One lever arm 16 of the two arm lever supports an inlet cone 22 and its other lever arm 17 is connected to a membrane 19 which delimits a pressure chamber 18 with respect to the control chamber 7. The membrane 19 is connected to the lever arm 17 by an intermediate piece **19*a*. The pressure chamber 18 communicates with the atmosphere through an opening 18*a*. When the pressure in the pressure chamber 18 is greater than that in the control chamber 7, the membrane 19 is displaced in the direction of the arrow 20. The two-arm lever 15 then is pivoted against the force of a spring 21 in a counterclockwise direction by the intermediate piece 19*a* thereby causing the inlet cone 22 of the valve to open the outlet opening of the fuel feed line 12 so that fuel can flow into the control chamber 7**.

The fuel delivery and the mixture preparation is brought about in the well-known manner by the suction developed by the engine by which, in turn, the quantity of air passing through the carburetor and pressure conditions prevailing therein are determined.

For chain saws, there are usually only two operational settings, namely the full-load setting and the idle-speed setting. For full-load operation, the throttle valve is fully open; whereas, at idle, the throttle valve 23 lies on the wall surface of the cross-section of the carburetor bore 3. The throttle valve 23 is pivotally mounted to swivel about shaft 24 (FIG. 2) and has a U-shaped recess or cutout 25 formed in its lower edge facing in a direction toward the control chamber 7. The recess 25 has a concave base 26 curved in a direction toward shaft 24. At the idle-speed setting of the engine, the throttle valve 23 lies closely and tightly at its peripheral edge 27 against the inner wall surface 28 of the carburetor bore 3. In this position, the throttle valve 23 is inclined at a small angle of about 15° with respect to a radial plane of the carburetor bore 3 in a direction toward the motor thereby assuming its permanently adjusted position for idling as shown in FIG. 1.

Figure 2:
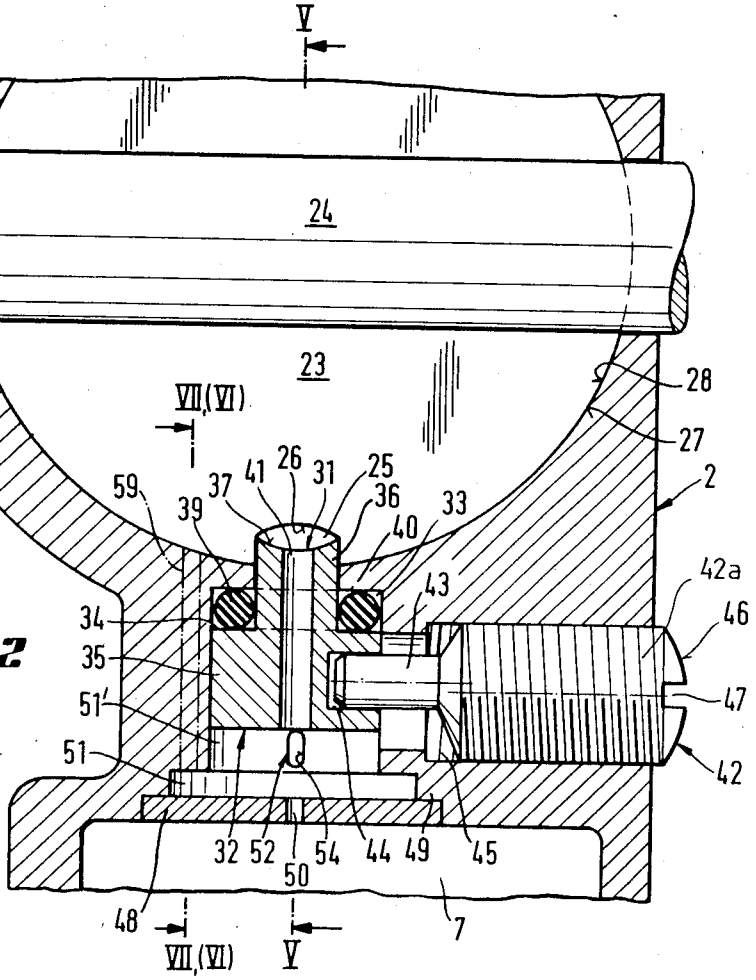
FIG. 2 is an enlarged view, in vertical section, of a portion of the carburetor of FIG. 1 taken along line II—II of FIG. 5 with the idling adjusting part shown in its upper position.
Figure 6:
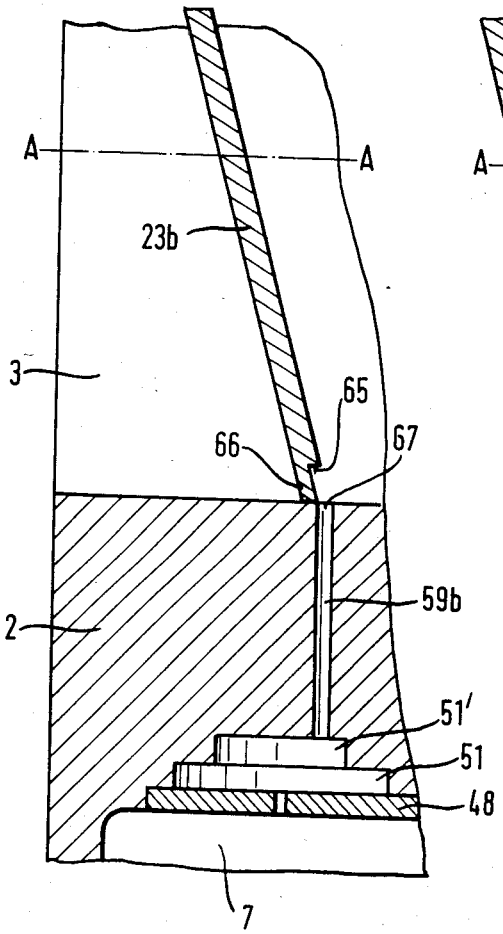
FIG. 6 is a section view taken along the line VI—VI of FIG. 3.
Figure 7:
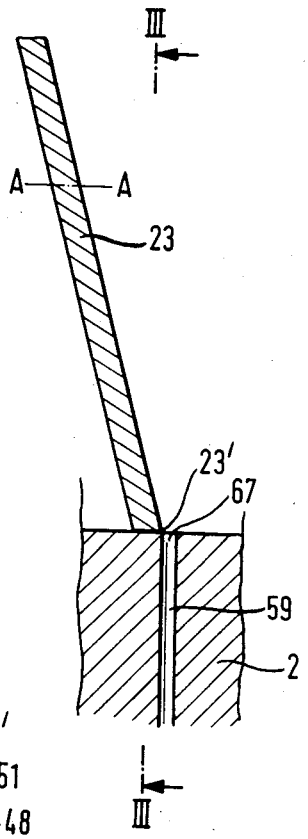
FIG. 7 is a section view taken along the line VII—VII of FIG. 3; however, another embodiment of the throttle valve in the area of the acceleration jet is shown here.

As shown in FIGS. 1, 2, and 5, a first inlet jet communicates with the region of the recess 25, this first inlet jet being the idle-speed jet 31. This jet 31 is disposed ahead of the throttle valve 23 in the flow direction of the fuel-air mixture formed in the venturi 4 and permits a small amount of emulsified fuel to enter the air stream continuously during idling. The jet 31 therefore defines here an idling fuel jet which supplies the engine with fuel when running at idling speeds.

The idling fuel outlet jet 31 is defined by a central bore 41 of a preferably cylindrical idling adjustment part 32, which is axially displaceable in a guide opening 33 (FIG. 3) corresponding thereto of the carburetor housing 2. At approximately mid elevation, the idling control part 32 has a circular, right-angled shoulder 34 from which the lower portion 35 of part 32 extends downwardly and faces in a direction toward the control chamber 7. The upper end portion of part 32 above shoulder 34 is identified by reference numeral 36.

Figure 3:
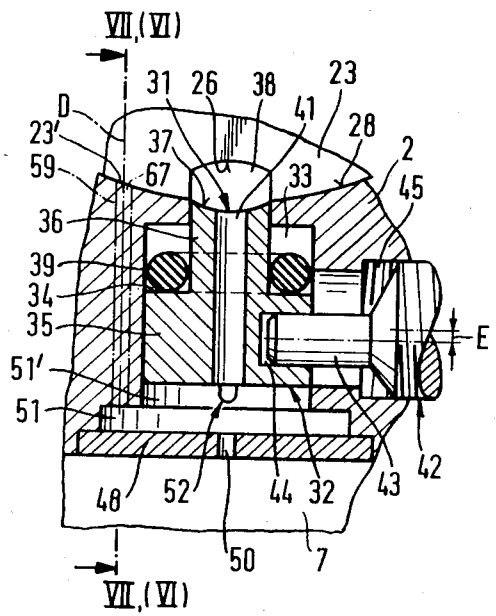
FIG. 3 is likewise an enlarged view showing the idling adjusting part in its lower position.

The idling fuel outlet jet 31 is arranged concentrically with respect to the idling control part 32 and extends along the entire length of the latter. In the illustrated embodiment of the invention, the end face 37 of the idling control part 32 is concavely curved so as to have almost the same radius of curvature as the base 26 of the recess 25 of the throttle valve 23 and, at the lowest position of the control part 32, this end face 37 is flush with the inner wall surface 28 of the carburetor bore 3 as shown in FIG. 3.

However, another suitable embodiment is also conceivable. The end face 37 and the recess 25 of the throttle valve 23 conjointly define an air gap 38 through which the air emerging in the direction of arrow P streams concentrated over the idling fuel outlet jet 31 which brings about an optimum swirling of the fuel emanating there and, in this way, causes an extremely favorable fuel mixture to be prepared.

For sealing the idling control part 32 with respect to the conducting opening 33, the stepped end 36 of the idling control part 32 is surrounded by a seal in the form of an O-ring 39. When the idling control part 32 is moved to its outermost position as shown in FIG. 2, the O-ring 39 fits snugly between shoulder 34 of part 32 and a step 40 of the carburetor housing 2. In order to obtain a lower idling speed from the maximum possible idling speed for the position shown in FIG. 3 and to thereby correspondingly reduce the size of the maximum air gap 38, the idling control part 32 is displaced to its outermost position so that its end 36 and the outlet opening 41 of the idling fuel outlet jet 31 are moved into the recess 25 of the throttle valve 23 as shown in FIG. 2. Accordingly, the idling control part 32 with the fuel outlet jet 31 can be adjusted as a unit in the direction of the pivot shaft 24 of the throttle valve 23.

An actuating member 42 configured as an eccentric screw is arranged in the carburetor housing 2 to adjust the position of the idling control part 32. The eccentric screw 42 has an elongated insert projection 43 mounted eccentrically with respect to the main body 42*a* thereof. The projection 43 extends into a corresponding insert opening 44 formed in the lower portion 35 of the idling control part 32 thereby engaging the latter. The eccentric screw 42 threadably engages a tapped bore 45 formed in the carburetor housing 2 and has a screwdriver slit 47 on the protruding exterior end thereof so that the screw can be rotated with a screwdriver or similar tool. In this way, the idling control part 32 can be maximally adjusted between its end positions corresponding to a displacement twice the eccentric dimension E (FIG. 3).

Also, an eccentric screw of the kind shown in FIG. 1 may be used wherein the screw is spring biased by a spring 42*b*. In lieu of an eccentric screw, any other desired type of a continuously adjustable part may be utilized.

The control chamber 7 is closed off at the top in the direction of the throttle valve 23 by a closure plate 48 which lies in a stepped recess 49 of the carburetor housing 2 as shown in FIG. 5. The closure plate 48 has a central fuel outlet jet 50 through which the fuel is sucked upwardly by the air stream flowing in the gap 38 into a fuel mixing chamber, namely the emulsion chamber 51, 51'. The emulsion chamber 51, 51' lies between the idling control part 32 and the cover plate 48. Referring to FIG. 5, an upwardly inclined ventilation jet 52 communicates with emulsion chamber 51, 51'. The ventilation jet 52 is arranged in a direction opposite to the direction of arrow P and toward the venturi 4 of the carburetor bore 3 so as to communicate with the latter as shown in FIG. 5.

Preferably, the air inlet opening 53 of the ventilation jet 52 lies in the transitional region between the conical air funnel or venturi 4 and the cylindrical segment of the carburetor bore 3. Also, as in the case of the idling fuel outlet jet 31, the air inlet jet 52 is preferably arranged so as to be symmetrical to the longitudinal plane of the carburetor bore 3, that is symmetrical to the plane of symmetry of the throttle valve 23 which is perpendicular to pivot shaft 24.

As shown in FIGS. 2, 3, and 5, the cross-sectional area of the opening 54 of the ventilation jet 52 communicating with emulsion chamber 51, 51' can be altered by adjusting the idling control part 32 so as to cause the latter to cover more or less of the opening 54. In the lowest position of the idling control part 32 (FIG. 3), the outlet opening 54 of the ventilation jet 52 is covered over by control part 32 so as to leave only a very small cross-sectional portion thereof uncovered; whereas, in the uppermost position of control part 32, the entire cross-sectional opening 54 is uncovered as shown in FIG. 2.

The emulsion chamber 51 is so dimensioned that in the lowest position of the idling control part 32, it is still sufficiently large that an adequate mixture of the emulsion of fuel and air is produced and, in the presence of a partial vacuum, is drawn by suction through the idling fuel outlet jet 31 into the air gap 38. At the uppermost position of the idling control part 32, more air flows through the outlet opening 54 of the ventilation jet 52 into the emulsion chamber 51, 51' than at the lowermost position of the idling control part 32 thereby causing the vaporized mixture to become leaner; whereas, at the lowermost position, the mixture is richer and corresponds to a higher engine speed. The idling control part 32 and the dimensions of the outlet opening 54 are so adjusted to each other, that when the idling speed of the engine is changed through displacement of the idling control part 32, the cross-sectional area of the outlet opening 54 is altered in such a way that the ratio of air to fuel, the so-called λ value, remains nearly constant.

Through this self-acting adjustment of the idling fuel-air ratio, it is only necessary to position the idling control part 32 to adjust the optimum idling speed so that the cross-sectional area of the fuel outlet opening 50 of the control chamber 7 does not need to be changed by an additional adjusting screw. Because tiring alternating adjustments of different controls are unnecessary, the optimum idling speed can be set even by inexperienced persons in a short time and without difficulty.

However, in the event that it should be possible nevertheless to make an adjustment of the quantity of fuel reaching the fuel mixing chamber from the control chamber (to compensate for machine-dependent tolerances or the like), the fuel outlet jet 50*a* from the control chamber 7*a*, can, as shown in FIG. 4, be positioned laterally outside of the closure plate 48*a*, so that it communicates with the emulsion chamber 51*a*, 51*a'* at the side thereof. The fuel delivery can then be adjusted by a set screw 56 which threadably engages the carburetor housing 2*a* and which extends into the side inlet opening 58 of the lowest portion of the emulsion chamber 51*a*, 51*a'* via a valve needle 57. By means of the set screw 56, the fuel supply can then be so adjusted on the job or by the service organization supplying the carburetor to compensate for tolerances, so that idling can again be adjusted during operation exclusively by means of the idling control adjusting part 32*a*.

Moreover, as shown in FIGS. 2 and 5 to 7, an acceleration jet 59 communicates with emulsion chamber 51, 51' which likewise leads to the carburetor bore 3 and, at the opening of the throttle valve 23 from the idle-speed position thereof, makes additional fuel available to accelerate the motor to higher rotational speed until supply is taken over by the main jet 60 (FIG. 1). Fuel is drawn into the carburetor bore 3 through the main jet 60, which is connected to the control chamber 7 and communicates with venturi 4, when the throttle valve is fully opened, in which case, the throttle valve lies in line with the direction of flow. The fuel supplied to the carburetor bore 3 can be adjusted by a volume flow controller 61 which is made up of a jet needle 62 and an opening 63 corresponding thereto in the carburetor housing, and is set by an adjustable screw 64 connected to the jet needle 62 as shown in FIG. 1.

The acceleration jet 59 is mounted in the carburetor outside the projection of the idling adjusting control part 32 and, at the idle setting of the throttle valve, lies immediately on the side of the throttle valve facing away from the idling fuel jet 31. In this way, the entire cross-sectional area of the acceleration jet 59 is kept clear of the edge 23' (FIG. 7) of the throttle valve 23, which edge 23' defines a control edge and passes over the opening of the acceleration jet 59 during operation of the throttle valve. The acceleration jet 59 lies very closely to the idling fuel outlet jet 31 and is spaced therefrom along the circumference of the venturi tube. This arrangement ensures that the acceleration jet 59 will be completely ventilated at the idling setting of the throttle valve, but at the opening of the throttle valve, will very quickly deliver the desired amount of supplementary fuel.

In any case, the acceleration jet 59 lies outside the idling control part 32. According to the embodiment of FIG. 6, the acceleration jet **59*b* communicates with the carburetor bore 3 downstream from a peripheral cutout 65 in the throttle valve 23*b* which has an edge portion 66 of reduced thickness in the vicinity of the cutout. This edge portion 66 forms the control edge of the throttle valve 23*b*. As a result of the edge portion of reduced thickness, the acceleration jet is effective within an even shorter time, when the throttle valve is only very slightly open, as then the edge portion 66 of the outlet opening 67 has already passed the acceleration jet 59*b***.

It is understood that the foregoing description is that of the preferred embodiments of the invention and that various changes and modifications may be made thereto without departing from the spirit and scope of the invention as defined in the appended claims.

What is claimed is:

1. Carburetor for an internal combustion engine, comprising:

a carburetor housing defining a carburetor bore communicating with the engine and through which a stream of air is drawn by suction when the engine is operating;

a plurality of fuel jets for delivering fuel into said bore and the stream of air flowing therethrough to form an air-fuel mixture for the engine;

a throttle flap pivotally mounted in said carburetor bore for adjusting the quantity of said mixture in dependence upon the operating condition of the engine;

said throttle flap being pivotable to an idle position whereat said throttle flap and the wall surface of said carburetor bore conjointly define an air gap for passing the air required for the idle operation of the engine;

a control compartment for holding the fuel for said fuel jets, said control compartment including an emulsion chamber;

one of said fuel jets being an idle speed fuel jet having its outlet opening in the region of said air gap, said idle speed fuel jet also communicating with said emulsion chamber;

air passage means for passing air to said emulsion chamber, said passage means having a pass-through opening communicating with said emulsion chamber; and, an idle speed adjusting member movably mounted in said carburetor housing for movement into said air gap to vary the cross-sectional area thereof while at the same time blocking off more or less of said pass-through opening in dependence upon the position of said adjusting member so as to cause the ratio of fuel to air of the emulsion in said emulsion chamber to be adapted to the air supply required by the engine as said emulsion flows out from said idle speed fuel jet.

2. Carburetor for an internal combustion engine, comprising:

a carburetor housing defining a carburetor bore communicating with the engine and through which a stream of air is drawn by suction when the engine is operating;

a plurality of fuel jets for delivering fuel into said bore and the stream of air flowing therethrough to form an air-fuel mixture for the engine;

a throttle flap pivotally mounted in said carburetor bore for adjusting the quantity of said mixture in dependence upon the operating condition of the engine;

said throttle flap being pivotable to an idle position whereat said throttle flap and the wall surface of said carburetor bore conjointly define an air gap for passing the air required for the idle operation of the engine;

a control compartment for holding the fuel for said fuel jets, said control compartment including an emulsion chamber;

one of said fuel jets being an idle speed fuel jet having its outlet opening in the region of said air gap, said idle speed fuel jet also communicating with said emulsion chamber;

air passage means for passing air to said emulsion chamber, said passage means having a pass-through opening communicating with said emulsion chamber; and, idle speed adjustment means for changing the cross-sectional area of said air gap while simultaneously changing the cross-sectional area of said pass-through opening so as to cause the ratio of fuel to air of the emulsion in said emulsion chamber to be adapted to the air supply required by the engine as said emulsion flows out from said idle speed fuel jet; said idle speed adjustment means including an idle speed adjusting member movably mounted in said carburetor housing for movement into said air gap to vary the cross-sectional area thereof while at the same time blocking off more or less of said pass-through opening in dependence upon the position of said adjusting member; and, positioning means for adjusting the position of said ajusting member with respect to said air gap and said pass-through opening; said air passage means being an air channel extending from said carburetor bore to said pass-through opening.

3. The carburetor of claim 2, said idle speed fuel jet being a through bore formed in said adjusting member and having a first end which opens into said air gap and a second end which opens into said emulsion chamber.

4. The carburetor of claim 3, said carburetor having a guide opening defining a longitudinal axis extending transversely to said throttle flap; and, said adjusting member being mounted in said opening so as to be movable therein along said axis.

5. The carburetor of claim 4, said adjusting member being an elongated member having a forward portion for projecting into said air gap when the member is moved in the direction of said axis toward said throttle flap, said member further having a rearward portion facing toward said emulsion chamber, said forward portion having a thickness less than said rearward portion measured in a direction transverse to said axis, said forward portion further having a concave end face formed in said forward portion, said first end of said through bore being disposed in said concave end face.

6. The carburetor of claim 5, said throttle flap having a peripheral edge, said peripheral edge having a cutout formed therein which approximates a U-shape, said U-shaped cutout and said wall surface of said carburetor bore conjointly defining said air gap, said guide opening being disposed in said carburetor housing relative to said throttle flap so as to cause said adjusting member to enter said U-shaped cutout when adjusted in position by said positioning means.

7. The carburetor of claim 6, said throttle flap defining an angle of approximately 15° with respect to a vertical plane perpendicular to the longitudinal axis of said carburetor bore when said throttle flap is in said idle position, said idle position being a fixed position to which said throttle flap always returns for the idle mode of operation of the engine.

8. The carburetor of claim 6, said U-shaped cutout having a cross-sectional area adapted to the maximum idle speed of the engine.

9. The carburetor of claim 6, said adjusting member being mounted in said guide opening so as to be movable between a retracted position and a fully extended position whereat said concave end face and said cutout conjointly define the smallest possible air gap corresponding to the lowest possible idle speed of the engine.

10. The carburetor of claim 2, said positioning means comprising an eccentric screw engaging said adjusting member and being threadably mounted in said housing so as to be accessible from the outside thereof for manually adjusting the same to, in turn, adjust the position of said adjusting member.

11. The carburetor of claim 10, said eccentric screw having a tapered forward insert portion; and, said adjusting member having an insert opening formed therein for receiving said insert portion.

12. The carburetor of claim 5, said control compartment including a partition wall for partitioning the same into said emulsion chamber and into a control chamber, said emulsion chamber being delimited in the direction of said longitudinal axis by the end face of said rearward portion of said adjusting member and said partition wall.

13. The carburetor of claim 12, said partition wall having a fuel nozzle formed therein for connecting said control chamber to said emulsion chamber.

14. The carburetor of claim 12, comprising: a fuel nozzle formed in said housing for connecting said control chamber to said emulsion chamber, said fuel nozzle defining a through passage of predetermined cross-sectional area; and, an adjusting screw threadably mounted in said housing so as to be movable into and out of said through passage so as to adjust the size of said cross-sectional area thereof, said adjusting screw being mounted in said housing so as to be accessible from the outside thereof for manually adjusting the same.

15. The carburetor of claim 5, said throttle flap having one side thereof facing toward the engine when said flap is in said idle position and the other side thereof facing away from the engine, said adjusting member being arranged in said carburetor housing so as to place said idle fuel jet on said one side of said throttle flap; another one of said plurality of fuel jets being an acceleration fuel jet and said other side of said throttle flap having a peripheral edge, said acceleration fuel jet being arranged in said housing on said other side of said throttle flap away from where said adjusting member projects into said carburetor bore so as to cause said edge of said throttle flap to be clear of the entire cross-sectional opening of said acceleration jet thereby causing said peripheral edge to define a control edge of said last-mentioned cross-sectional opening.

16. The carburetor of claim 15, a portion of said flap being stepped at the region thereof adjacent said acceleration fuel jet, the stepped portion extending to said last-mentioned edge in the region of said acceleration fuel jet thereby causing said acceleration fuel jet to become effective when said throttle flap is moved open only slightly out of its idle position.

17. Carburetor for an internal combustion engine, comprising:

a carburetor housing defining a carburetor bore communicating with the engine and through which a stream of air is drawn by suction when the engine is operating;

a plurality of fuel jets for delivering fuel into said bore and the stream of air flowing therethrough to form an air-fuel mixture for the engine;

a throttle flap pivotally mounted in said carburetor bore for adjusting the quantity of said mixture in dependence upon the operating condition of the engine;

said throttle flap being pivotable to an idle position whereat said throttle flap and the inner wall surface of said carburetor bore conjointly define an air gap for passing the air required for the idle operation of the engine;

a control compartment for holding the fuel for said fuel jets, said control compartment including an emulsion chamber;

one of said fuel jets being an idle speed fuel jet having its outlet opening in the region of said air gap, said idle speed fuel jet also communicating with said emulsion chamber;

air supply means for passing air into said emulsion chamber;

an idle speed adjusting member displaceably mounted in said housing so as to be movable between an extended position whereat said adjusting member extends into said air gap thereby reducing the cross-sectional area thereof to a predetermined minimum while at the same time adjusting said air supply means so that the latter supplies an increased quantity of air to said emulsion chamber corresponding to a minimum idle speed and, a retracted position whereat said adjusting member is withdrawn from said air gap thereby increasing the cross-sectional area thereof to a predetermined maximum while at the same time adjusting said air supply means so that the latter supplies a reduced quantity of air to said emulsion chamber corresponding to a maximum idle speed; and, positioning means for positioning said idle speed adjusting member in the range defined by said extended and retracted positions to obtain an optimum idle speed for the engine.

* * * * *